US006402291B1

(12) United States Patent
Millman et al.

(10) Patent No.: US 6,402,291 B1
(45) Date of Patent: Jun. 11, 2002

(54) COMPOSITE WIPER FOR INKJET PRINTHEADS

(75) Inventors: Michael S. Millman; Jeffrey J. Anderson, both of Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/495,028

(22) Filed: Jan. 31, 2000

(51) Int. Cl.[7] ..... B41J 2/165
(52) U.S. Cl. ..... 347/33
(58) Field of Search ..... 347/33; 15/250, 15/361

(56) References Cited

U.S. PATENT DOCUMENTS

| | | | |
|---|---|---|---|
| 4,264,191 | A | 4/1981 | Gerbasi et al. |
| 4,823,161 | A | 4/1989 | Yamada et al. |
| 5,103,244 | A | 4/1992 | Gast et al. |
| 5,115,250 | A | 5/1992 | Harmon et al. |
| 5,151,715 | A | 9/1992 | Ward et al. |
| 5,300,958 | A | 4/1994 | Burke et al. |
| 5,489,927 | A | 2/1996 | Harmon |
| 5,500,660 | A | 3/1996 | Childers et al. |
| 5,539,435 | A | 7/1996 | Uchida et al. |
| 5,583,548 | A | 12/1996 | Kearns |
| 5,602,573 | A | 2/1997 | Waschhauser et al. |
| 5,614,930 | A | 3/1997 | Osborne et al. |
| 5,621,441 | A | 4/1997 | Waschhauser et al. |
| 5,644,347 | A | 7/1997 | Schwiebert et al. |
| 5,745,133 | A | 4/1998 | Hendricks et al. |
| 5,815,176 | A | 9/1998 | Rotering |
| 5,896,145 | A | 4/1999 | Osborne et al. |
| 5,949,448 | A | 9/1999 | Man et al. |
| 5,980,018 | A | 11/1999 | Taylor et al. |
| 5,997,128 | A | 12/1999 | Lou et al. |
| 6,084,608 | A | 7/2000 | Harvey et al. |

FOREIGN PATENT DOCUMENTS

| | | |
|---|---|---|
| DE | 4210160 | 9/1993 |
| EP | 0446885 | 9/1991 |
| EP | 1010535 | 6/2000 |
| GB | 2053093 | 2/1981 |

*Primary Examiner*—Huan Tran

(57) ABSTRACT

A composite wiper assembly is provided for cleaning ink residue from an inkjet printhead in an inkjet printing mechanism. The composite wiper has a wiper blade with a first portion of a first elastomeric material, and a second portion of a second elastomeric material different from the first elastomeric material. The wiper blade may also have a third portion of a third elastomeric material different from the first elastomeric material and different from the second elastomeric material. The composite structure of the wiper blade allows the materials of the different portions to be tailored to best serve the function of a particular portion. An inkjet printing mechanism having such a composite wiper is also provided.

64 Claims, 3 Drawing Sheets

COMPOSITE WIPER FOR INKJET PRINTHEADS

FIELD OF THE INVENTION

The present invention relates generally to inkjet printing mechanisms, and more particularly to a composite wiper for removing ink residue from an inkjet printhead.

BACKGROUND OF THE INVENTION

Inkjet printing mechanisms use cartridges, often called "pens," which eject drops of liquid colorant, referred to generally herein as "ink," onto a page. Each pen has a printhead formed with very small nozzles through which the ink drops are fired. To print an image, the printhead is propelled back and forth across the page, ejecting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is supported by the printer chassis so the printhead can be moved over the station for maintenance. For storage, or during non-printing periods, the service stations usually include a capping system which substantially seals the printhead nozzles from contaminants and drying. Some caps are also designed to facilitate priming, such as by being connected to a pumping unit that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the printhead. The wiping action is usually achieved through relative motion of the printhead and wiper, for instance by moving the printhead across the wiper, by moving the wiper across the printhead, or by moving both the printhead and the wiper.

To improve the clarity and contrast of the printed image, recent research has focused on improving the ink itself. To provide quicker, more waterfast and light-fast printing with darker blacks and more vivid colors, pigment-based inks have been developed. These pigment-based inks have a higher solid content than the earlier dye-based inks, which results in a higher optical density for the new inks. Both types of ink dry quickly, which allows inkjet printing mechanisms to form high quality images on readily available and economical plain paper, as well as on recently developed specialty coated papers, transparencies, fabric and other media.

As the inkjet industry investigates new printhead designs, the tendency is toward using permanent or semi-permanent printheads in what is known in the industry as an "off-axis" printer. In an off-axis system, the printheads carry only a small ink supply across the printzone, with this supply being replenished through tubing that delivers ink from an "off-axis" stationary reservoir placed at a remote, stationary location within the printer. Since these permanent or semi-permanent printheads carry only a small ink supply, they may be physically narrower than their predecessors, the replaceable cartridges. Narrower printheads lead to a narrower printing mechanism, which has a smaller "footprint," so less desktop space is needed to house the printing mechanism during use. Narrower printheads are usually smaller and lighter, so smaller carriages, bearings, and drive motors may be used, leading to a more economical printing unit for consumers.

There are a variety of advantages associated with these off-axis printing systems, but the permanent or semi-permanent nature of the printheads requires special considerations for servicing, particularly when wiping ink residue from the printheads. In the past, the printhead wipers have been a single or dual wiper blade made of an elastomeric or plastic material. One earlier wiper blade assembly had a composite wiper, with one side being of elastomeric material, and the other side being of an absorbent fabric material, similar to a felt. This composite absorbent wiper blade had basically a sandwiched structure, using a bonding agent to join the felt pad to one side surface of an otherwise conventional elastomeric wiper blade. Presumably, the felt half of the wiper blade was used to absorb liquid ink residue. Then through capillary forces, the felt material pulled the liquid residue away from the wiper tip.

In past printhead wiping routines, typically the printhead was translated across the wiper in a direction parallel to the scan axis of the printhead. In one printer, the wipers were rotated about an axis perpendicular to the printhead scan axis to wipe. Today, most inkjet pens have nozzles aligned in two linear arrays which run perpendicular to the scanning axis. Using these earlier wiping methods, first one row of nozzles was wiped and then the other row of nozzles was wiped. While these earlier wiping methods proved satisfactory for many traditional dye based inks, unfortunately, they were unacceptable for many newer fast drying pigment inks.

One suitable service station design for pigment-based inks was a rotary device first sold in the DeskJet® 850C and 855C color inkjet printers, and later in the DeskJet® 820C and 870C color inkjet printers by Hewlett-Packard Company of Palo Alto, Calif., the present assignee. This rotary device mounted the wipers, primers and caps on a motor-operated tumbler. These pens were wiped using an orthogonal wiping technique, where the wipers ran along the length of the linear nozzle arrays, wicking ink along the arrays from one nozzle to the next to serve as a solvent to break down ink residue accumulated on the nozzle plate. A camming device moved a horizontal arm carrying a wiper scraper into position to clean ink residue from the wipers as they rotated past. The scraper arm had capillary channels formed along the under surface from the scraper tip to an absorbent blotter pad.

A translational or sliding orthogonal wiping system was first sold by the Hewlett-Packard Company in the DeskJet® 720C and 722C color inkjet printers. The wipers were slid under a stationary horizontal, rigid plastic wiper bar to clean off any clinging ink residue. This wiper bar had an inverted T-shaped head which assisted in scraping the wipers clean. Another wiper system using rotational and vertical motion was first sold by the Hewlett-Packard Company in the DeskJet® 2000C Professional Series color inkjet printer.

This was one of the first service station systems in a Hewlett-Packard Company inkjet printer to use an ink solvent, specifically polyethylene glycol ("PEG"), to clean and lubricate the printheads. This service station required two costly motors to operate the service station for moving the service station servicing components both vertically and rotationally.

Most earlier wipers were typically made of a single elastomeric or plastic material, which required comprises to be made in the flexibility of the wiper versus the wiper tip characteristics. Since the entire wiper structure was made of the same material, tailoring the material characteristics of the wiper tip, which contacts the printhead, was impossible without comprising on the flexibility of the blade.

Wiper blade flexibility is important for several reasons. For instance, the flexibility of the wiper blade determines the amount of normal force applied to the orifice plate. Here, the term "normal force" does not mean the regular amount of force, but rather the engineering term indicating the force which is applied in a direction that is perpendicular to the plane of the orifice plate surface. The amount of normal force applied to the orifice plate affects the wiping capability of the wipers. Too large of a normal force may damage the orifice plate. Indeed, if this normal force is too large, in some printers the printheads may become unseated from their carriage alignment datums. Tangential or shear forces in the wiping direction are also important to assure adequate cleaning of the printhead, and these forces are also affected by the degree of wiper bending.

The flexibility of the wipers is also used to accommodate tolerance stack in the service station components, the printer, the inkjet printhead, and the printhead carriage. The term "tolerance stack" refers to the accumulation of the various manufacturing tolerances of components used to construct a particular inkjet printer, where some components may be at the maximum permissible size, while others are at the minimum permissible size. Regardless of which components are used to construct a particular printer, it must function for both extremes of the tolerance stack spectrum, and the wiper blades have been selected to accommodate the tolerance stack variations between the printhead orifice plate and the service station wiper sled. For spacings between the orifice plate and the base of the wiper which are near the smallest extreme, the wiper needs to flex more, and for spacings which are near the largest extreme, the wiper flexes less. From the extreme of maximum flexion to the extreme of minimum flexion, the wiper must adequately clean the printhead without damaging the printhead. Thus, flexibility is a very important factor in wiper design.

Wiper tip design is also a very important factor in wiper design, because the tip is the portion of the wiper which actually contacts the printhead. Besides tip geometry, selection of the tip material is a critical design criteria. For instance, granularity in the wiper tip material may actually scratch the printhead over time, and or damage the nozzle orifices. A damaged nozzle orifice may cause the nozzles to misdirect ink droplets, or expel ink droplets of an inappropriate drop weight, with both of these consequences impacting print quality. Furthermore, selection of the wiper tip material impacts the friction between the wiper and the orifice plate. Over time, excessive friction can also damage the orifice plate. Moreover, this friction may cause the wiper to wear, shortening the life of the wiper and the service station. Another unfortunate consequence of wiper wear is the possibility of forcing torn pieces of the wiper into a nozzle, causing permanent nozzle damage.

Thus, a need exists for a new wiper structure, which can be tailored to meet the competing needs of blade flexibility, and wiper tip characteristics.

SUMMARY OF THE INVENTION

According to one aspect of the present invention, a composite wiper is provided for cleaning ink residue from an inkjet printhead in an inkjet printing mechanism. The composite wiper has a wiper blade with a first portion of a first elastomeric material, and a second portion of a second elastomeric material different from the first elastomeric material. In an illustrated embodiment, the wiper blade further includes a third portion of a third elastomeric material different from the first elastomeric material and different from the second elastomeric material.

According to a further aspect of the present invention, an inkjet printing mechanism may be provided with a composite wiper as described above.

An overall goal of the present invention is to provide an inkjet printing mechanism which prints sharp vivid images over the life of the printhead and the printing mechanism, particularly when using fast drying pigment or dye-based inks, and preferably when dispensed from an off-axis system.

Another goal of the present invention is to provide a wiping system for cleaning printheads in an inkjet printing mechanism to prolong printhead life.

Still another goal of the present invention is to provide a printhead wiping system for cleaning printheads in an inkjet printing mechanism, with the system having fewer parts that are easier to manufacture than earlier systems, and which thus provides consumers with a reliable, economical inkjet printing unit.

DETAILED DESCRIPTION OF A PREFERRED EMBODIMENT

Figure 1:
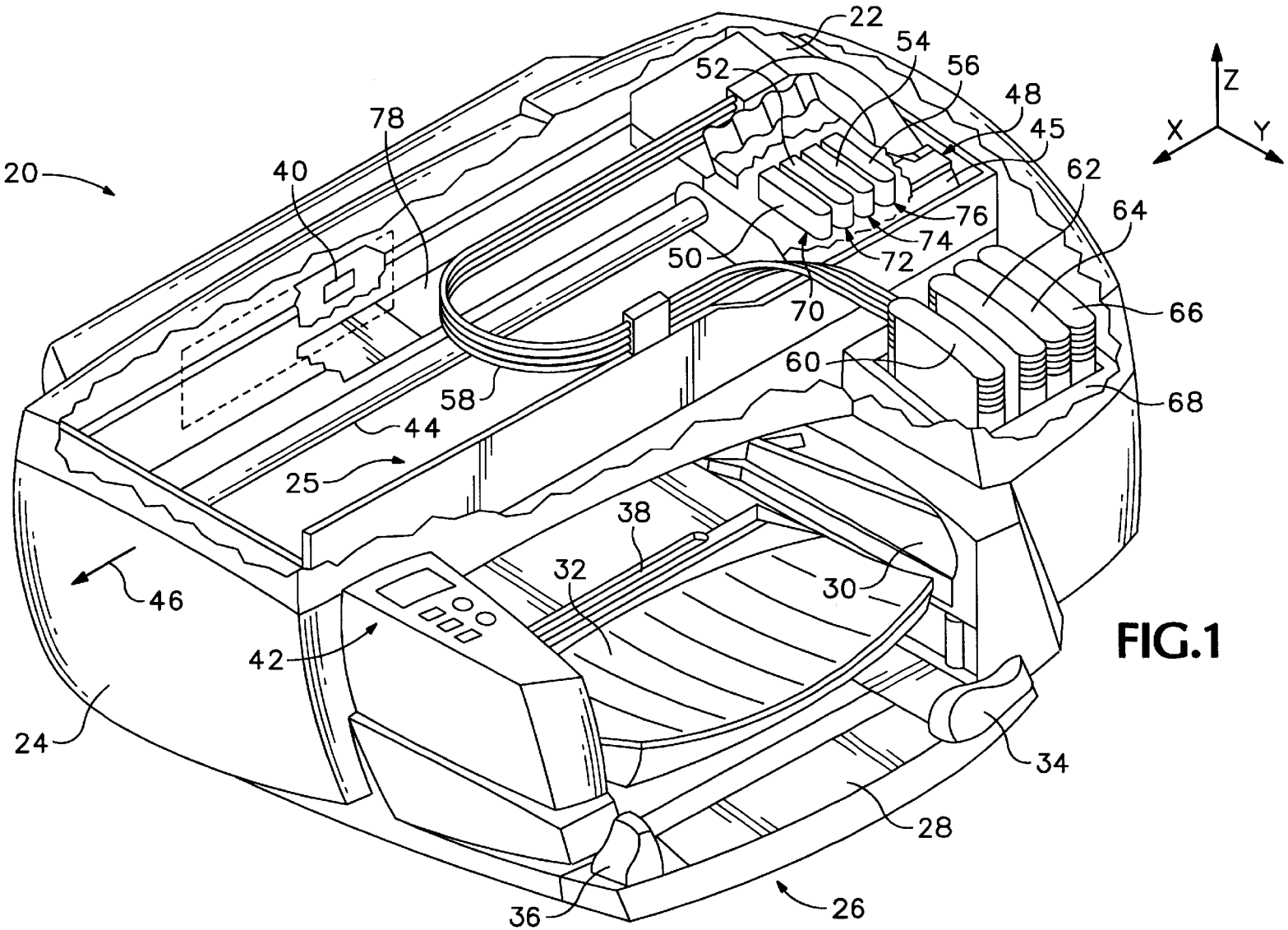
FIG. 1 is a perspective view of one form of an inkjet printing mechanism, here, an inkjet printer, including a printhead service station having one form of a composite wiper of the present invention for removing ink residue from an inkjet printhead.

FIG. 1 illustrates an embodiment of an inkjet printing mechanism, here shown as an "off-axis" inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few, as well as various combination devices, such as a combination facsimile/printer. For convenience the concepts of the present invention are illustrated in the environment of an inkjet printer 20.

While it is apparent that the printer components may vary from model to model, the typical inkjet printer 20 includes a frame or chassis 22 surrounded by a housing, casing or enclosure 24, typically of a plastic material. Sheets of print media are fed through a printzone 25 by a media handling system 26. The print media may be any type of suitable sheet material, such as paper, card-stock, transparencies, photographic paper, fabric, mylar, and the like, but for convenience, the illustrated embodiment is described using paper as the print medium. The media handling system 26 has a feed tray 28 for storing sheets of paper before printing. A series of conventional paper drive rollers driven by a stepper motor and drive gear assembly (not shown), may be used to move the print media from the input supply tray 28, through the printzone 25, and after printing, onto a pair of extended output drying wing members 30, shown in a retracted or rest position in FIG. 1. The wings 30 momentarily hold a newly printed sheet above any previously printed sheets still drying in an output tray portion 32, then the wings 30 retract to the sides to drop the newly printed sheet into the output tray 32. The media handling system 26 may include a series of adjustment mechanisms for accommodating different sizes of print media, including letter, legal, A-4, envelopes, etc., such as a sliding length adjustment lever 34, a sliding width adjustment lever 36, and an envelope feed port 38.

The printer 20 also has a printer controller, illustrated schematically as a microprocessor 40, that receives instructions from a host device, typically a computer, such as a personal computer (not shown). The printer controller 40 may also operate in response to user inputs provided through a key pad 42 located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 44 is supported by the chassis 22 to slideably support an off-axis inkjet pen carriage system 45 for travel back and forth across the printzone 25 along a scanning axis 46. The carriage 45 is also propelled along guide rod 44 into a servicing region, as indicated generally by arrow 48, located within the interior of the housing 24. A conventional carriage drive gear and DC (direct current) motor assembly may be coupled to drive an endless belt (not shown), which may be secured in a conventional manner to the carriage 45, with the DC motor operating in response to control signals received from the controller 40 to incrementally advance the carriage 45 along guide rod 44 in response to rotation of the DC motor. To provide carriage positional feedback information to printer controller 40, a conventional encoder strip may extend along the length of the printzone 25 and over the service station area 48, with a conventional optical encoder reader being mounted on the back surface of printhead carriage 45 to read positional information provided by the encoder strip. The manner of providing positional feedback information via an encoder strip reader may be accomplished in a variety of different ways known to those skilled in the art.

Figure 2:
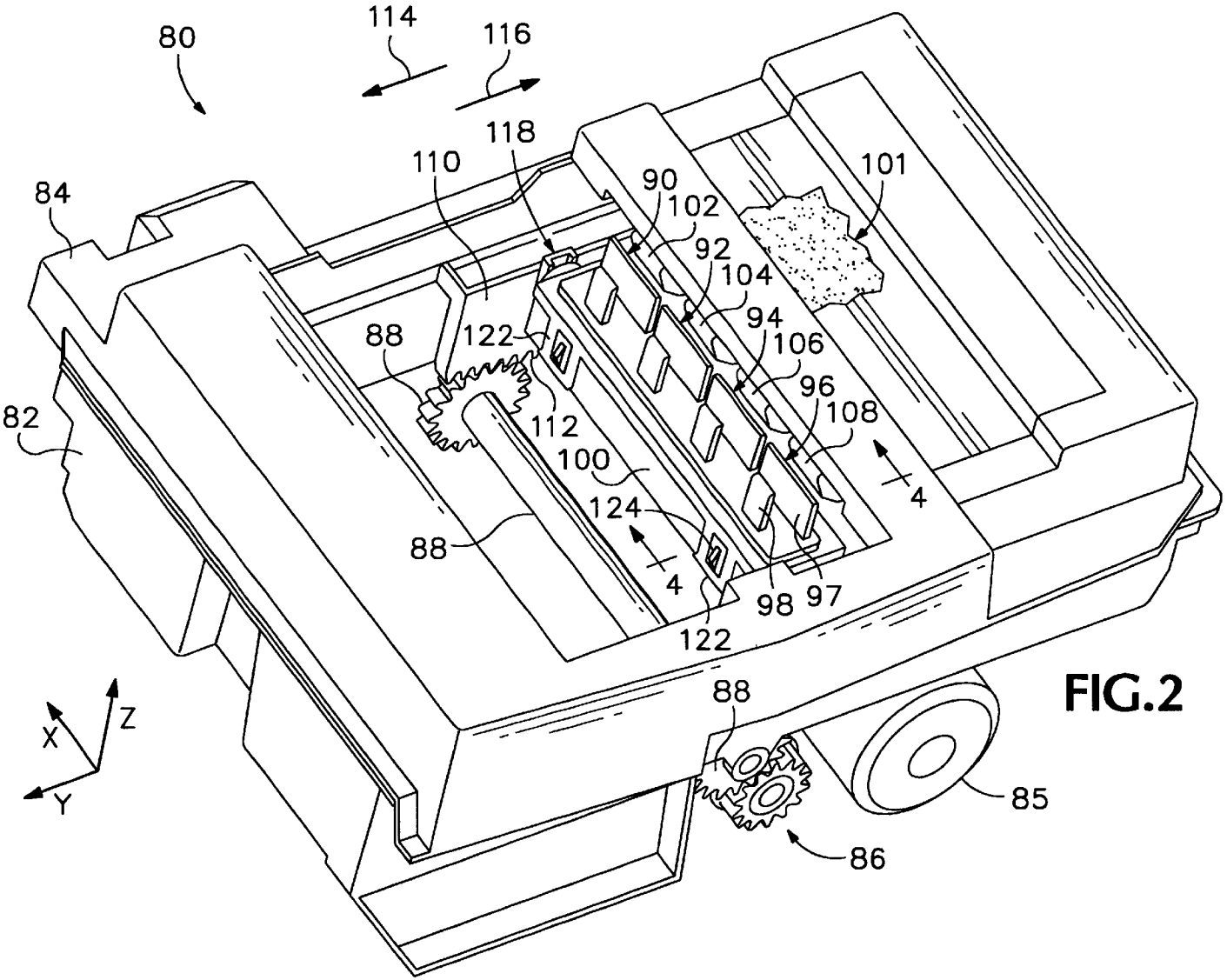
FIG. 2 is a perspective view of the service station of FIG. 1.

In the printzone 25, the media sheet 34 receives ink from an inkjet cartridge, such as a black ink cartridge 50 and three monochrome color ink cartridges 52, 54 and 56, shown schematically in FIG. 2. The cartridges 50–56 are also often called "pens" by those in the art. The black ink pen 50 is illustrated herein as containing a pigment-based ink. While the illustrated color pens 52–56 may contain pigment-based inks, for the purposes of illustration, color pens 52–56 are described as each containing a dye-based ink of the colors cyan, magenta and yellow, respectively. It is apparent that other types of inks may also be used in pens 50–56, such as paraffin-based inks, as well as hybrid or composite inks having both dye and pigment characteristics.

The illustrated pens 50–56 each include small reservoirs for storing a supply of ink in what is known as an "off-axis" ink delivery system, which is in contrast to a replaceable cartridge system where each pen has a reservoir that carries the entire ink supply as the printhead reciprocates over the printzone 25 along the scan axis 46. Hence, the replaceable cartridge system may be considered as an "on-axis" system, whereas systems which store the main ink supply at a stationary location remote from the printzone scanning axis are called "off-axis" systems. In the illustrated off-axis printer 20, ink of each color for each printhead is delivered via a conduit or tubing system 58 from a group of main stationary reservoirs 60, 62, 64 and 66 to the on-board reservoirs of pens 50, 52, 54 and 56, respectively. The stationary or main reservoirs 60–66 are replaceable ink supplies stored in a receptacle 68 supported by the printer chassis 22. Each of pens 50, 52, 54 and 56 have printheads 70, 72, 74 and 76, respectively, which selectively eject ink to form an image on a sheet of media in the printzone 25. The concepts disclosed herein for cleaning the printheads 70–76 apply equally to the totally replaceable inkjet cartridges, as well as to the illustrated off-axis semi-permanent or permanent printheads, although the greatest benefits of the illustrated system may be realized in an off-axis system where extended printhead life is particularly desirable.

The printheads 70, 72, 74 and 76 each have an orifice plate with a plurality of nozzles formed therethrough in a manner well known to those skilled in the art. The nozzles of each printhead 70–76 are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction perpendicular to the scanning axis 46, with the length of each array determining the maximum image swath for a single pass of the printhead. The illustrated printheads 70–76 are thermal inkjet printheads, although other types of printheads may be used, such as piezoelectric printheads. The thermal printheads 70–76 typically include a plurality of resistors which are associated with the nozzles. Upon energizing a selected resistor, a bubble of gas is formed which ejects a droplet of ink from the nozzle and onto a sheet of paper in the printzone 25 under the nozzle. The printhead resistors are selectively energized in response to firing command control signals delivered by a multi-conductor strip 78 from the controller 40 to the printhead carriage 45.

FIG. 2 shows one form of a printhead service station 80, constructed in accordance with the present invention for maintaining the health of the printheads 70–76. The service station 80 has a frame which includes a lower deck 82 and an upper deck 84, which may be joined together by screws, a snap fit, or other fastener devices. The frame lower deck 82 supports a service station motor 85, a gear assembly 86, and a spindle gear 88. The motor 85 drives the gear assembly 86, which in turn drives the spindle gear 88 to move various printhead servicing components into position to service each of the printheads 70–76 when in the servicing region 48. For example, four wiper assemblies 90, 92, 94 and 96 are moved through the action of motor 85, gear assembly 86 and spindle gear 88, to wipe ink residue from the printheads 70, 72, 74 and 76, respectively. Each of the wiper assemblies 90–96 has a large wiper 97, which wipes across the entire orifice plate, and a dedicated nozzle wiper 98 which concentrates on the central nozzle region of the printhead. Each of the wiper assemblies 90–96 are supported by a wiper sled 100, which operates as described further below.

Other servicing components may be also supported by the service station frame 82, 84. For instance, to aid in removing ink residue from printheads 70–76, an ink solvent is used, such as a hygroscopic material, for instance polyethylene glycol ("PEG"), lipponic-ethylene glycol ("LEG"), diethylene glycol ("DEG"), glycerin or other materials known to those skilled in the art as having similar properties. These hygroscopic materials are liquid or gelatinous compounds that will not readily dry out during extended periods of time because they have a large molecular size which leads to a low, almost zero, vapor pressure. This ink solvent is stored in an ink solvent reservoir 101 which is supported along an interior surface of the frame upper deck 84. For the purposes of illustration, the preferred ink solvent used in system 98 is PEG.

Figure 3:
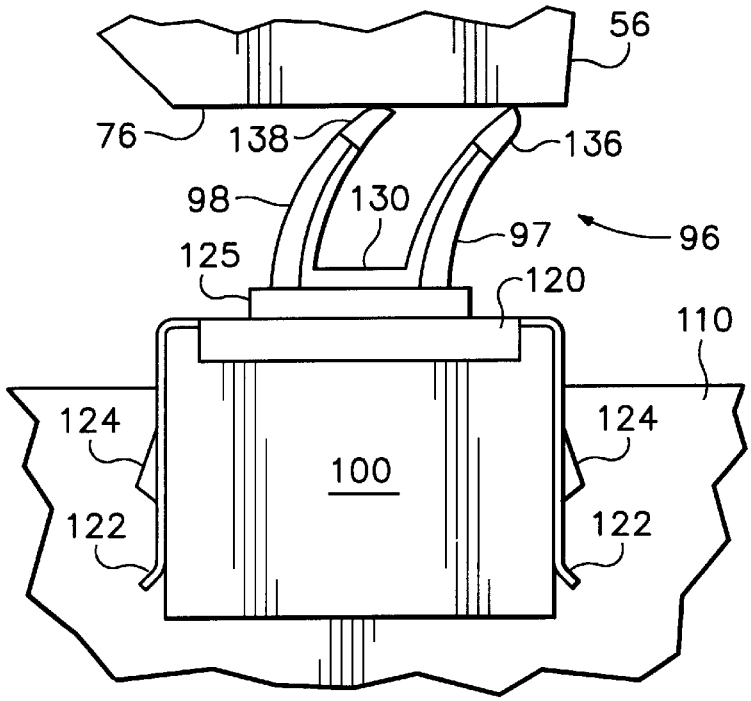
FIG. 3 is a side elevational view, which shows the composite wiper of the service station of FIG. 2 in the process of wiping an inkjet printhead.

Another main component of the service station 80 is a pallet 110, which has a rack gear 112 that is engaged by the spindle gear 88 to be driven by motor 85 and gear assembly 86 in a forward direction indicated by arrow 114 and a rearward direction indicated by arrow 116. The wiper sled 100 is supported by the pallet 110, for instance at support 118. FIG. 3 shows the color wiper assembly 96 wiping printhead 76 of pen 56. Prior to beginning the wiping cycle, preferably ink solvent from reservoir 101 is applied to the wiper assemblies 90–96 through rearward movement 116 of the pallet 110 which causes the wiper blades 97 to contact the solvent applicator pads 102–108, respectively.

Figure 4:
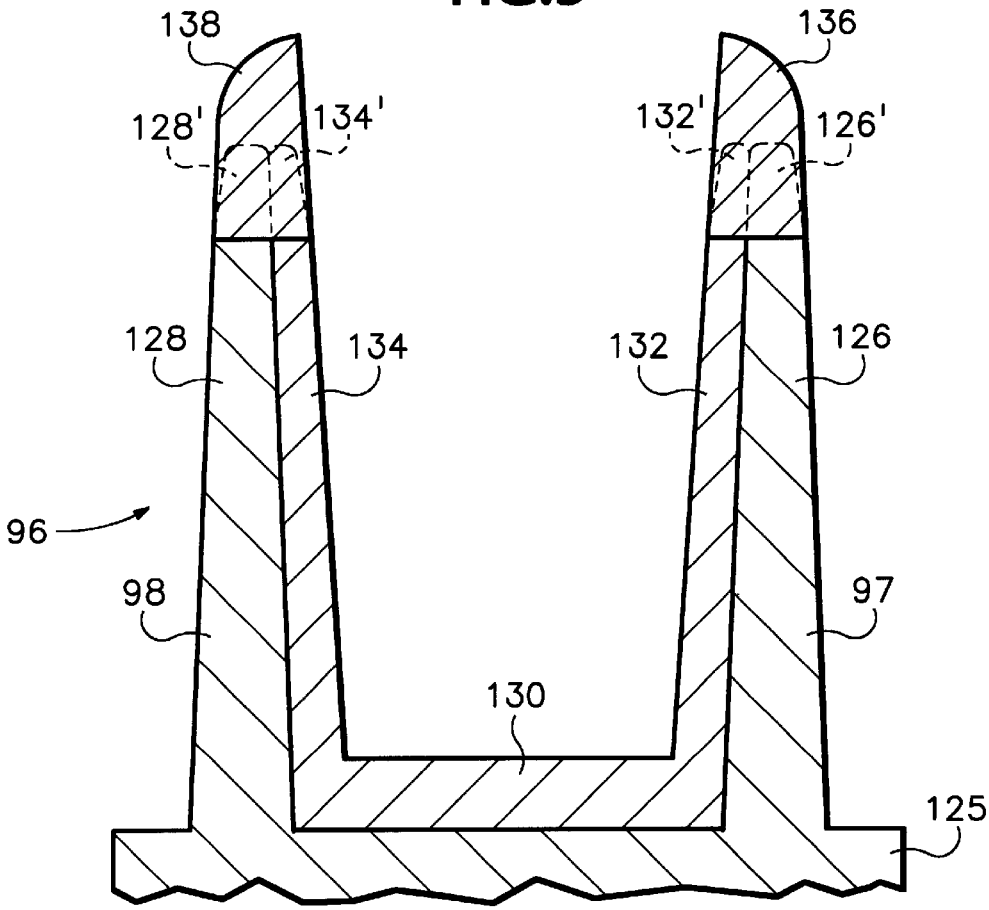
FIG. 4 is a sectional view of the composite wiper of the service station of FIG. 2, taken along lines 4—4 thereof.

FIGS. 3 and 4 illustrate preferred embodiments for the construction of wiper assemblies 90–96, with assembly 96 being shown as an example of a dual blade composite wiper, constructed in accordance with the present invention. Preferably, the wiper blades 97, 98 of assemblies 90–96 are insert molded onto a metallic wiper mount 120 of a stainless steel having spring properties. The illustrated wiper mount 120 has several spring tabs 122 which are snap fit over mounting ears 124 projecting from the sled 100. Similar mounting techniques for wiper blades have been used on earlier products, such as in the Hewlett-Packard Company's DeskJet® 720 and 722 models of color inkjet printers.

The wiper assembly 96 includes a main base 125 of a resilient, non-abrasive, elastomeric material, such as nitrile rubber, silicone, ethylene polypropylene diene monomer (EPDM), or other comparable materials known in the art, but preferably of an EPDM material. The wiper assembly 96 includes two outboard blade portions 126 and 128 which extend upwardly from the base 125 to form a portion of blades 97 and 98, respectively. To achieve improved root strength, a fixed interior base portion 130 of a different elastomeric material may be molded to overlay the EPDM main base 125. Projecting upwardly from this interior base portion 130 is a pair of interior wiper blade portions 132 and 134 which line the respective outboard blade sections 126, 128 to form another portion of blades 97, 98.

While either the root material of the interior blade sections 132, 134 or the EPDM material of the outboard blade portions 126, 128 may extend to form the wiping tips, preferably a third material is used to form a pair of wiper tips 136 and 138 of the respective wiper blades 97, 98. For instance, the wiper tips 136, 138 may be constructed of an elastomeric material without fillers, such as Acetyl M90, which is produced by the Hoescht Salineze Company of Kent, Wash. Typical fillers in elastomers are carbon, silica, clays, calcium carbonate and polyethylene. These fillers have abrasive properties which have been known to scratch the orifice plates over time depending on the particle size, often damaging the nozzles. Other suitable elastomeric materials for the wiper tips include silicone rubbers, nitro butyl rubbers ("NBR"), polyurethanes, and thermoplastic elastomers ("TPE"). Such a composite wiper constructed from two or three separate elastomeric materials may be molded in various progressive molding stages, using the heat of the later-fabricated layers to bond them to the earlier-fabricated layers. Alternatively, the components may be separately molded then bonded together, but a progressive molding scheme is preferred.

As another example, the wiper tips 136, 138 may be constructed of a cleanroom material, such as silicone rubber, which is often used in medical applications. These clean room materials are preferred for the wiper tips 136, 138 because they have fewer particulates which have traditionally been known to scratch the printhead orifice plate. Another reason for selecting such clean room materials for the tips is to facilitate the fabrication process for mixing the compounds, allowing the use of the cleaner liquid injection molding process, rather than the dirtier milling operation. In liquid injection molding, the compounds may be mixed before molding so the chance of introducing abrasive particulate contaminates into the compound is reduced. However, these cleanroom materials would be unsuitable for a root material for the blade assembly because the material durometer is too low, leading to excessive blade flexing and inadequate wiping forces.

In an alternate embodiment, the wiper tips 136, 138 may be separately manufactured wiper tips which are bonded over the upper ends of the wiper blade segments 126, 132 and 128, 134, as shown in FIG. 4 by dashed line extensions of these blade segments which form tip cores labeled 126', 132' and 128', 134', respectively. In such a composite tip embodiment, the wiper tips 136, 138 may be constructed of a variety of different materials, such as of a silicone or EPDM material having a hollow interior which receives the extended tip cores 126', 132' and 128', 134", respectively. Suitable materials and processes for attaching the tip covers to the blade segment extensions 126', 132' and 128', 134" include bonding with adhesives or other bonding agents, or using a two-stage molding process. One advantage of the composite tip embodiment is the ability to select the most appropriate tip material for a particular pen or ink, e.g. pigment-based inks versus dye-based inks, while maintaining the same root material.

Of course it is apparent that any of the materials used to construct the wiper assemblies 90–96 must be selected also for their ink compatibility characteristics with pens 50–56. While the illustrated tip geometry, having rounded exterior wiping edges and angular interior wiping edges, as first described in the Hewlett-Packard Company's U.S. Pat. No. 5,614,930, it is apparent that the tip geometry may be adjusted for different implementations. Furthermore, while the illustrated composite wiper assembly 96 has a dual blade construction, it is apparent that this composite wiper concept of using different materials for a wiper blade may also be applied to single blade structures, as well as to blade assemblies having more than two blades. Indeed, even in a dual blade structure, it may be desirable to construct one blade with one set of materials and the other blade with another set of materials. Furthermore, by segmenting design constraints, different wipers may be used for dye based color orifice plates 72–76, and the black wiper assembly 90 for wiping pen 50 which dispenses a pigment based ink.

Moreover, while the illustrated concept is shown as a layered construction, in some implementations it may be preferable to have bases 125, 130, and blade segments 126, 128, 132, 134 all constructed of a single material, with only the wiper tips 136, 138 being of a different material. Furthermore, in some implementations, it may be desirable to have the material of the main base 125 extend upwardly along a portion of blades 97, 98, then introduce a separate intermediary layer of a different material between the base material and the tip material. Similarly, it may be desirable to place the root reinforcing layers 130, 132, 134 along the outboard side of blade segments 126 and 128. In other implementations, the root reinforcing layer 130, 132, 134 may extend over only a portion of the width of the wiper blades 97, 98. Additionally, material selection affects other system design constraints, such as the ability to pick the desired amount of ink solvent from the applicator pads 102–108. Clearly, the inventive concepts described herein by way of the illustrated embodiments maybe implemented in a variety of different ways which still fall within the scope of the claims below.

CONCLUSION

Thus, a variety of advantages are realized using the composite wiper tip assembly 96 as described herein by way of a preferred embodiment. For example, the composite wiper 96 allows for multiple materials to be used at the wiper tip and at the wiper root. In this fashion, the materials may be independently optimized for their wear and surface contact characteristics at the wiper tips 136, 138, while also being optimized for strength along the wiper root 126, 132, 128, 134, 125, 130. Optimizing the strength of the wiper root affects the resultant force applied by the wiper tips to a printhead orifice plate, which impacts wiping ability, printhead wear, and wiper wear. For example, by using an elastomeric material with a filler, root strength is improved, while using an elastomeric material without fillers at the tip minimizes wiping friction and orifice plate wearing. Moreover, by using a material for the wiper tips 136, 138 which has minimal particulates, scratching of the orifice plate is advantageously avoided. Thus, the composite wiper minimizes damage done by the wiper blades 97, 98 to the orifice plate of the printheads 70–76. Furthermore, wiper design flexibility is increased with the composite wiper because the design constraints are now segmented. Segmenting the design constraints allows them to be individually balanced for optimum performance, so a design tradeoff is no longer required between optimizing for root strength and performance of the wiper tip. Thus, the composite wiper 96 is able to provide superior wiping performance, leading to higher print quality, while minimizing printhead wear to provide consumers with a long lasting, robust printing unit.

We claim:

1. A composite wiper for cleaning ink residue from an inkjet printhead in a printing mechanism, comprising a first wiper blade having:

a first portion of a first elastomeric material;

a second portion of a second elastomeric material, different from the first elastomeric material; and a wiper tip of a third elastomeric material which is in contact with the first portion and the second portion, with the wiper tip contacting the printhead during a wiping stroke while isolating the first and second portions from contact with the printhead.

2. A composite wiper according to claim 1 wherein the third elastomeric material is the same as the first elastomeric material.

3. A composite wiper according to claim 2 wherein the first elastomeric material is a less abrasive material than the second elastomeric material.

4. A composite wiper according to claim 2 wherein the first elastomeric material is blended without fillers, and the second elastomeric material is blended with fillers.

5. A composite wiper according to claim 2 wherein the first elastomeric material is a cleanroom material.

6. A composite wiper according to claim 2 wherein the second elastomeric material is a stiffer material than the first elastomeric material.

7. A composite wiper according to claim 2 wherein the second elastomeric material is of a higher durometer material than the first elastomeric material.

8. A composite wiper according to claim 1 wherein the third elastomeric material is different than both the first elastomeric material and the second elastomeric material.

9. A composite wiper according to claim 8 wherein the third elastomeric material is of a less abrasive material than the first and second elastomeric materials.

10. A composite wiper according to claim 8 wherein the third elastomeric material is blended without fillers.

11. A composite wiper according to claim 8 wherein the third elastomeric material is a cleanroom material.

12. A composite wiper according to claim 1 further including a second wiper blade having:

a first portion of the first elastomeric material;

a second portion of the second elastomeric material; and a wiper tip of the third elastomeric material which is in contact with the first and second portions of the second wiper blade, with the wiper tip of the second wiper blade contacting the printhead during the wiping stroke while isolating the first and second portions of the second wiper blade from contact with the printhead.

13. A composite wiper according to claim 12 wherein the first and second portions of the first wiper blade support the wiper tip.

14. A composite wiper according to claim 13 wherein:

the first portion of the first wiper blade has an exterior surface and an opposing interior surface; and the second portion of the first wiper blade has an exterior surface and an opposing interior surface which overlays the interior surface of the first portion of the first wiper blade.

15. A composite wiper according to claim 13 wherein:

the wiper tip defines a hollow interior chamber; and the first and second portions of the first wiper blade each have a core portion which extends into the hollow interior chamber of the wiper tip.

16. A composite wiper according to claim 12, further comprising a base portion of the second elastomeric material which joins together the first and second wiper blades.

17. A composite wiper according to claim 12 wherein the third elastomeric material is of the same composition as the first elastomeric material.

18. A composite wiper according to claim 12 wherein the third elastomeric material is of a composition different than the compositions of both the first and second elastomeric materials.

19. A printing mechanism, comprising:

a frame;

an inkjet printhead supported by the frame for printing in a printzone and for servicing in a servicing region; and a composite wiper located in the servicing region for cleaning ink residue from the printhead, with the composite wiper comprising a first wiper blade having:

a first portion of a first elastomeric material;

a second portion of a second elastomeric material, different from the first elastomeric material; and a wiper tip of a third elastomeric material which is in contact with the first portion and the second portion, with the wiper tip contacting the printhead during a wiping stroke while isolating the first and second portions from contact with the printhead.

20. A printing mechanism according to claim 19 wherein the third elastomeric material is the same as the first elastomeric material.

21. A printing mechanism according to claim 19 wherein the third elastomeric material is different than both the first elastomeric material and the second elastomeric material.

22. A printing mechanism according to claim 19 further including a second wiper blade having:

a first portion of the first elastomeric material;

a second portion of the second elastomeric material; and a wiper tip of the third elastomeric material which is in contact with the first and second portions of the second wiper blade, with the wiper tip of the second wiper blade contacting the printhead during the wiping stroke while isolating the first and second portions of the second wiper blade from contact with the printhead.

23. A printing mechanism according to claim 22, further comprising a base portion of the second elastomeric material which joins together the first and second wiper blades.

24. A printing mechanism according to claim 22 wherein the third elastomeric material is of the same composition as the first elastomeric material.

25. A printing mechanism according to claim 22 wherein the third elastomeric material is of a composition different than the compositions of both the first and second elastomeric materials.

26. A printing mechanism according to claim 25 wherein:

the first and second portions of the first wiper blade each have distal ends which are surrounded by the wiper tip of the first wiper blade; and the first and second portions of the second wiper blade each have distal ends which are surrounded by the wiper tip of the second wiper blade.

27. A printing mechanism according to claim 25 wherein:

the wiper tip of the first wiper blade defines a hollow interior chamber;

at least one of the first and second portions of the first wiper blade has a core portion which extends into the hollow interior chamber of the wiper tip of the first wiper blade;

the wiper tip of the second wiper blade defines a hollow interior chamber; and at least one of the first and second portions of the second wiper blade has a core portion which extends into the hollow interior chamber of the wiper tip of the second wiper blade.

28. A composite wiper for cleaning ink residue from an inkjet printhead in a printing mechanism, comprising a first wiper blade having:

a first portion of a first elastomeric material having a first surface;

a second portion of a second elastomeric material, different from the first elastomeric material, with the second portion having a second surface bonded to said first surface; and a wiper tip of a third elastomeric material which defines an attachment portion;

wherein the first and second portions of the first wiper blade each have a core portion which is attached to the attachment portion of the wiping tip of the first wiper blade.

29. A composite wiper according to claim 28 wherein the third elastomeric material is of a less abrasive material than the first and second elastomeric materials.

30. A composite wiper according to claim 28 wherein the third elastomeric material is blended without fillers.

31. A composite wiper according to claim 28 wherein the third elastomeric material is a cleanroom material.

32. A composite wiper according to claim 28 wherein the first elastomeric material and the third elastomeric material are the same elastomeric material.

33. A composite wiper according to claim 28 further including a second wiper blade having:

a first portion of a fourth elastomeric material having a first surface;

a second portion of a fifth elastomeric material, different from the fourth elastomeric material, with the second portion having a second surface bonded to said first surface; and a wiper tip of a sixth elastomeric material which defines an attachment portion;

wherein the first and second portions of the second wiper blade each have a core portion which is attached to the attachment portion of the wiping tip of the second wiper blade.

34. A composite wiper according to claim 33 wherein the third and sixth elastomeric materials are blended without fillers.

35. A composite wiper according to claim 33 wherein the third and sixth elastomeric materials are of a cleanroom material composition.

36. A composite wiper according to claim 33 wherein the first, third, fourth and sixth elastomeric materials are of the same composition.

37. A composite wiper according to claim 33 wherein:

the first and fourth elastomeric materials are of the same composition;

the second and fifth elastomeric materials are of the same composition; and the third and sixth elastomeric materials are of the same composition which has an abrasive property which is less abrasive than an abrasive property of the composition of either of the first or second elastomeric materials.

38. A composite wiper according to claim 37, further comprising a base portion of the second elastomeric material which joins together the second portions of the first and second wiper blades.

39. A composite wiper for cleaning ink residue from am inkjet printhead in a printing mechanism, comprising:

a blade portion of a first elastomeric material having opposing base and distal ends; and a tip portion of a second elastomeric material, different from the first elastomeric material, wherein the tip portion defines a hollow interior chamber which receives the distal end of the blade portion.

40. A composite wiper according to claim 39 wherein the chamber of the tip portion surrounds the distal end of the blade portion.

41. A composite wiper according to claim 39 wherein the second elastomeric material is of a less abrasive material than the first elastomeric material.

42. A composite wiper according to claim 39 wherein the second elastomeric material is blended without fillers.

43. A composite wiper according to claim 39 wherein the second elastomeric material is a cleanroom material.

44. A composite wiper according to claim 39 further including:

a blade reinforcement portion of a third elastomeric material, different from the first elastomeric material;

wherein the blade portion has a body portion which separates the base and distal ends; and wherein the reinforcement portion extends along at least a segment of the body portion.

45. A composite wiper according to claim 46 wherein the reinforcement portion extends along the body portion from the base end to the distal end, with the reinforcement portion also being received within the chamber of the tip portion.

46. A composite wiper according to claim 39 wherein the tip portion is bonded to the distal end of the blade portion.

47. A composite wiper according to claim 46 wherein the tip portion is bonded to the distal end of the blade portion using an adhesive material.

48. A composite wiper according to claim 39 wherein the tip portion is bonded to the distal end of the blade portion by molding first molding either the tip portion or the blade portion then molding and heat-bonding the other of the tip portion or the blade portion thereto.

49. A printing mechanism, comprising:

a frame;

an inkjet printhead supported by the frame for printing in a printzone and for servicing in a servicing region;

a composite wiper located in the servicing region for cleaning ink residue from the printhead, with the composite wiper comprising:

a blade portion of a first elastomeric material having opposing base and distal ends; and a tip portion of a second elastomeric material, different from the first elastomeric material, wherein the tip portion defines a hollow interior chamber which receives the distal end of the blade portion.

50. A printing mechanism according to claim 49 wherein the chamber of the tip portion surrounds the distal end of the blade portion.

51. A printing mechanism according to claim 49 wherein the second elastomeric material is of a less abrasive material than the first elastomeric material.

52. A printing mechanism according to claim 49 wherein the second elastomeric material is blended without fillers.

53. A printing mechanism according to claim 49 wherein the second elastomeric material is a cleanroom material.

54. A printing mechanism according to claim 49 further including:

a blade reinforcement portion of a third elastomeric material, different from the first elastomeric material;

wherein the blade portion has a body portion which separates the base and distal ends; and wherein the reinforcement portion extends along at least a segment of the body portion.

55. A printing mechanism according to claim 52 wherein the reinforcement portion extends along the body portion from the base end to the distal end, with the reinforcement portion also being received within the chamber of the tip portion.

56. A printing mechanism according to claim 49 wherein the tip portion is bonded to the distal end of the blade portion.

57. A printing mechanism according to claim 56 wherein the tip portion is bonded to the distal end of the blade portion using an adhesive material.

58. A printing mechanism according to claim 49 wherein the tip portion is bonded to the distal end of the blade portion by molding first molding either the tip portion or the blade portion then molding and heat-bonding the other of the tip portion or the blade portion thereto.

59. A printing mechanism according to claim 49 wherein the blade portion comprises a first blade portion, the tip portion comprises a first tip portion, the chamber comprises a first chamber and the composite wiper further comprises:

a second blade portion of a third elastomeric material having opposing base and distal ends;

a second tip portion of a fourth elastomeric material, different from the third elastomeric material, wherein the second tip portion defines a second hollow interior chamber which receives the distal end of the second blade portion; and an interior base portion which separates the first and second blade portions.

60. A printing mechanism according to claim 59 wherein:

the third elastomeric material is of the same composition as the first elastomeric material; and the fourth elastomeric material is of the same composition as the second elastomeric material.

61. A printing mechanism according to claim 59 further including:

a reinforcement portion of a fifth elastomeric material, different from the first and third elastomeric materials;

wherein the first and second blade portions each have an interior surface, with said interior surfaces each facing toward the interior base portion; and wherein the reinforcement portion extends along at least a segment of each of the first and second blade portions.

62. A printing mechanism according to claim 61 wherein the reinforcement portion extends along the interior base portion.

63. A printing mechanism according to claim 61 wherein the reinforcement portion extends along each of the first and second blade portions from the base end to the distal end, with the reinforcement portion also being received within the chambers of the first and second tip portions.

64. A printing mechanism according to claim 63 wherein the reinforcement portion extends along the interior base portion.

* * * * *

UNITED STATES PATENT AND TRADEMARK OFFICE

CERTIFICATE OF CORRECTION

PATENT NO. : 6,402,291 B1
DATED : June 11, 2002
INVENTOR(S) : Michael S. Millmen et al.

It is certified that error appears in the above-identified patent and that said Letters Patent is hereby corrected as shown below:

Column 12,
Line 52, "am" should read -- -an --.

Signed and Sealed this

Thirty-first Day of December, 2002

JAMES E. ROGAN
*Director of the United States Patent and Trademark Office*